United States Patent [19]

Matthäus et al.

[11] 4,370,514

[45] Jan. 25, 1983

[54] HIGH-VOLTAGE BUSHING WITH DOUBLE-LAYERED POTENTIAL CONTROL INSERTS

[75] Inventors: Günther Matthäus, Spardorf; Joachim Ruffer, Erlangen, both of Fed. Rep. of Germany

[73] Assignee: Siemens Aktiengesellschaft, Munich, Fed. Rep. of Germany

[21] Appl. No.: 203,373

[22] Filed: Nov. 3, 1980

[30] Foreign Application Priority Data

Nov. 15, 1979 [DE] Fed. Rep. of Germany ..... 2946172

[51] Int. Cl.[3] ..... H01B 17/28

[52] U.S. Cl. ..... 174/31 R; 174/73 R; 174/143

[58] Field of Search ..... 174/25 R, 25 G, 31 R, 174/73 R, 73 SC, 105 R, 142, 143; 361/275, 302, 304, 330

[56] References Cited

U.S. PATENT DOCUMENTS

| | | | |
|---|---|---|---|
| 3,390,312 | 6/1968 | England | 361/304 |
| 3,462,545 | 8/1969 | Grimmer | 174/143 |

FOREIGN PATENT DOCUMENTS

| | | | |
|---|---|---|---|
| 45-22650 | 7/1970 | Japan | 174/143 |
| 223139 | 2/1943 | Switzerland | 174/143 |
| 244927 | 6/1947 | Switzerland | 174/143 |
| 339227 | 12/1930 | United Kingdom | 174/143 |
| 1129995 | 10/1968 | United Kingdom | 174/143 |

*Primary Examiner*—Laramie E. Askin

*Attorney, Agent, or Firm*—Kenyon & Kenyon

[57] ABSTRACT

A high voltage insulating bushing formed of wound insulating foils is provided with a double layer material interposed between preselected windings of the insulating foils. The double layer material is formed of insulating material which has been laminated with an electrically conductive material, such as aluminum, and serves to advantageously distribute the electric field potential throughout the insulator body. The double layer material is arranged so that the electrically conductive material faces inwardly toward a longitudinal axis of the insulator body. The edges of a double layer foil which are near the outer surface of the insulator body are folded inward to form an edge wherein the electrically conductive material is enclosed within the insulating layer. In some embodiments, voids formed between the insulating foils and the folded edges of the double layer material are filled with an insulating medium, such as $SF_6$ gas.

4 Claims, 2 Drawing Figures

FIG 2

HIGH-VOLTAGE BUSHING WITH DOUBLE-LAYERED POTENTIAL CONTROL INSERTS

BACKGROUND OF THE INVENTION

This invention relates generally to bushings for insulating conductors bearing high voltages from ground potential, and more particularly, to an insulating body having insulating foils wound thereon which contain electrically conductive potential control inserts.

DISCUSSION OF THE PRIOR ART

It is often desirable in high voltage systems to pass high voltage conductors bearing potentials of 100 kilovolts and more through or near other parts which are at ground potential. Typical high voltage situations which have a high possibility of producing arcing and flashover include terminals of high voltage transformers and terminations of high voltage cables in switch gear. There is a need, therefore, for high voltage insulating devices which will prevent arcing with certainty.

The prior art has thrust at the problem of undesirable voltage breakdowns by providing bushing insulators of the type which surround high voltage conductors. One such insulator bushing is described in British Pat. No. 1,129,995. The bushing described therein is formed by winding flexible, electrically insulating material, illustratively a foil-like insulating paper, around the conductor. The bushing contains inserts of electrically conductive foil material which are wound concentrically with respect to one another, and insulated from each other. The conductive inserts function within the bushing to control the distribution of the electric field throughout the bushing insulator, and thereby improve the ability of the bushing to withstand surge voltages. For a discussion of the characteristics of dielectric materials see: B. P. Boning; Kleines Lehrbuch der Elektrischen Festigkeit (Small Textbook on Dielectric Strength), Karlsruhe 1955, pages 140 to 142.

It is known that the ability to withstand partial corona discharges and surge voltages is limited in high voltage bushing insulators, of the type described above, by the axial electric field strength at the outer edges of the electrically conductive potential control inserts. In known high voltage bushing insulators, the outside edges of the potential control inserts are terminated in bead-like enlargements which are produced, for example, by bending the potential control inserts around ring-shaped wires. This is done so as to obtain a radius of curvature at the outside edge of the insert which is as large as possible. Moreover, the outside edges may be surrounded by a layer of material having a high dielectric constant (see CH-Patents No. 244,927 and 223,139). In high voltage insulators which have such bead-like outer edges, the potential control inserts are always disposed outside of the wound insulating body becuase the edges are too large to be wound within the insulating body, and would result in loose insulator foil windings with undesirable creases.

It is, therefore, an object of this invention to improve the ability of high voltage insulators to withstand partial corona discharges and surge voltages.

SUMMARY OF THE INVENTION

The foregoing and other objects are achieved by this invention which provides a high voltage insulating bushing having potential control inserts which are formed of double layer foils, each foil having a layer of electrically conductive material and a layer of insulating material having a high dielectric constant $\epsilon_r$. The outer boundary edges of the potential control inserts are formed by folding the double layer foils so that the insulating layer encloses the electrically conducting layer.

It is a feature of this invention that the double-layer foils can be folded at their edges so as to have a small radius of curvature. This permits the potential control inserts to be entirely disposed within the winding of the body of the insulator bushing, without creasing the insulating foil.

In some embodiments of the invention, the voids which are produced between insulating foils which are adjacent to either side of the potential control inserts, and the edge of each insert, may be filled with an insulating medium. This reduces the magnitude of the electric field at the metal edges, thereby reducing the possibility of partial corona discharge and improving the surge voltage strength of the bushing. It may be desirable, in some embodiments, to utilize for the insulating layers of the double layer foils an insulating material formed of foils of plastic having a dielectric constant $\epsilon_r$of at least 2, and preferably 3. The double layer foils which comprise th potential control inserts may be formed of a plastic which has been laminated with aluminum.

BRIEF DESCRIPTION OF THE DRAWINGS

Comprehension of the invention is facilitated by reading the following detailed description in conjunction with the annexed drawings, in which.

DETAILED DESCRIPTION

Figure 1:
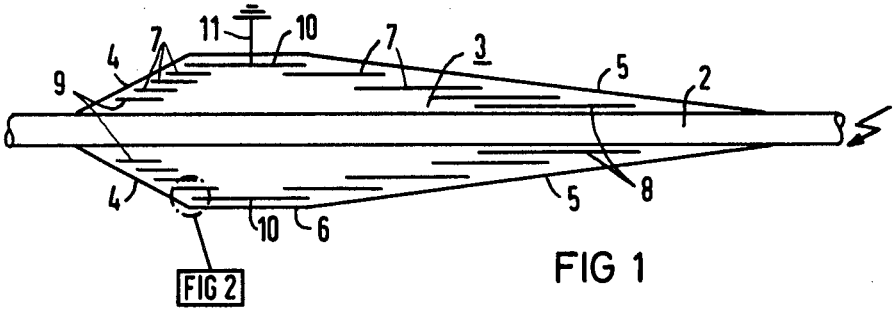
FIG. 1 is a schematic representation of a high voltage insulating bushing constructed in accordance with the principles of the invention.

FIG. 1 shows a longitudinal cross-sectional view of a high voltage insulating bushing which may be used, for example, as part of a termination of a high voltage cable (see: "Third International Symposium of High Voltage Engineering," Milan, Aug. 28–31, 1979, Report No. 32.09). The insulating bushing is provided with a central conductor 2 which may be a copper tube bearing a high voltage, illustratively 200 kilovolts at 50 hertz. An insulator body 3 is concentrically arranged around the conductor, and has two tapered conical surface portions 4 and 5 on respective sides of a cylindrical surface 6. The insulator bushing is wound from an insulating foil which may be a special paper or a plastic foil. Capacitor inserts 7, 8, 9 and 10 are represented in the figure by lines which are shown parallel to the central longitudinal axis (not specifically shown) of the conductor. The inserts are arranged with respect to one another so as to achieve a linear potential gradient along tapered surfaces 4 and 5 in a direction which extends outwardly from the central longitudinal axis of the conductor. Substantially linear potential distribution may be achieved along the surfaces 4 and 5 by the advantageous selection of the radial distances between the individual capacitor inserts with respect to the central longitudinal axis of the conductor. (See, for example: U.S. Pat. No. 3,462,545). In such an arrangement, capacitor inserts 8 and 9, which are closest to conductor 2, are at high voltage potential, while the outermost capacitor insert 10 near cylindrical surface 6 is provided with a terminal 11 for permitting an electrical connection to ground.

In some embodiments of the invention, the dielectric strength of insulator body 3 may be increased by optional impregnation with an insulating medium. Such a medium may be a special oil, or a gas, such as sulfur hexafluoride ($SF_6$). It will be assumed that the specific illustrative embodiment of insulator bushing 3 under discussion is impregnated with $SF_6$ (see: CIGRE 1972, Paper No. 15-02).

High voltage bushing embodiments which are intended for use at low temperatures, such as terminations of superconducting cables, may be saturated with a cryogenic medium such as helium (see: German Patent Application DE-OS No. 2,327,629).

Figure 2:
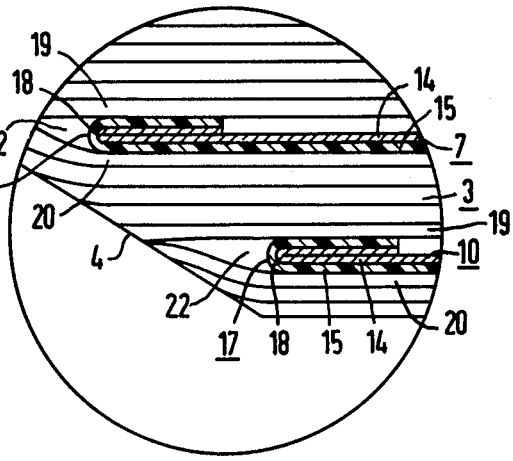
FIG. 2 is a magnified view of a portion of the bushing of FIG. 1, showing greater detail.

It has been learned that the partial corona discharge and surge voltage characteristics of an insulator bushing are limited essentially by the axial electric field strength at the outer edges of the electrically conductive potential control inserts 7–10, which are disposed near conical surfaces 4 and 5. FIG. 2 shows the design of such outer edges in detail. Structural elements in FIG. 2 which have correspondence to structural elements in FIG. 1 are identified with the same reference symbols.

The portion shown as a longitudinal cross-section in FIG. 2 of insulator body 3 contains two capacitor inserts 7 and 10 of double layer foils which are arranged parallel to one another. Each of these double layer foils contains an electrically conductive layer 14, and an insulating layer 15. The insulating layer, in this embodiment, consists of a material having a high dielectric constant $\epsilon_r$, which may be greater than 2, and preferably greater than 3. Plastic materials such as polyvinylchloride (PVC), polyethylene (PE), polypropylene (PP), or polycarbonate (PC) may be laminated with aluminum and are suitable for use as the double layer foils. Hard PVC material is particularly advantageous in that it has a dielectric constant $\epsilon_r$ between 3.8 and 4.3 at room temperature. As shown in FIG. 2 the double layer foils are concentrically arranged about the longitudinal central axis of the conductor so as to have insulating layers 15 disposed on the other side of the conductive layers 14 from the longitudinal central axis. Edges 18 which are near tapering surface 4 are formed by bending the double layer foils inward so that electrically conducting layers 14 are tightly enclosed by insulating layers 15. Since the electrically conducting material and the surrounding plastic material can be folded or bent relatively easily and with a small radius of curvature, sharp bends or breaks at the edges are prevented.

As seen in FIG. 2, each of double layer foils 7 and 10 is arranged between associated adjacent layers 19 and 20 of insulating foils. In some embodiments, the insulating foils may be of a plastic material such as PP. Gusset-like voids 22 are formed between the surfaces of insulating foils 19 and 20, and edges 17 of the insulating layers of the double layered inserts. Contact between the insulating medium in voids 22 and edges 18 of the electrically conductive layers of inserts 7 and 10 is prevented by the close fit between insulating layers 15 of the inserts, and the respective insulating layers 19 and 20. Thus, the electric field strength produced at edges 17 is lower than the electric field strength in the insulating medium thereby improving the partial corona discharge and surge voltage characteristics.

Although the inventive concept disclosed herein has been described in terms of a specific embodiment and application, other applications and embodiments will be obvious to persons skilled in the pertinent art without departing from the scope of the invention. Thus, for example, although the specific illustrative embodiment has been disclosed as a high voltage insulating bushing arranged around an electric conductor at high voltage with respect to ground, the invention is equally well-suited for use in arrangements wherein high voltage potential is applied to the outside of the bushing, and ground potential is applied to the central conductor. The drawings and descriptions of the specific illustrative embodiment of the invention in this disclosure are illustrative of applications of the invention and should not be construed to limit the scope thereof.

What is claimed is:

1. A high voltage insulating bushing of the type having at least one conductor part at a high voltage with respect to at least a second conductor part at a reference potential, the insulating bushing further having an insulator body formed of wound insulating foils with at least one electrically conductive potential control insert disposed within preselected insulating foil windings in the insulator body, the high voltage insulator bushing comprising:

at least one double layer foil which forms the electrically conductive potential control insert, said double layer foil being prefabricated in the form of continuous and coextensive contiguous layers of electrically conductive material and insulating material, said insulating material having a high dielectric constant $\epsilon_r$, said double layer foil being folded upon itself along an edge near an outer boundary surface of the insulating body to form an edge wherein said electrically conductive layer is enclosed within said insulating layer of said double layer foil; and an insulation medium impregnating the high voltage insulating bushing.

2. The insulating bushing of claim 1 wherein the insulating material of the insulating layer of the double layer foil has a dielectric constant, $\epsilon_r$, greater than 3 at room temperature.

3. The insulating bushing of claims 1 or 2 wherein the insulating layer of the double layer foil is formed of plastic material.

4. The insulating bushing of claim 3 wherein said plastic material forming said insulating layer is laminated with aluminum to form said electrically conductive layer.

* * * * *